US006780820B2

(12) United States Patent
Bobsein

(10) Patent No.: US 6,780,820 B2
(45) Date of Patent: Aug. 24, 2004

(54) THERMOSENSITIVE RECORDING MATERIAL

(75) Inventor: Barrett Richard Bobsein, Sellersville, PA (US)

(73) Assignee: Rohm and Haas Company, Philadelphia, PA (US)

( * ) Notice: Subject to any disclaimer, the term of this patent is extended or adjusted under 35 U.S.C. 154(b) by 88 days.

(21) Appl. No.: 09/880,996

(22) Filed: Jun. 14, 2001

(65) Prior Publication Data

US 2002/0123425 A1 Sep. 5, 2002

Related U.S. Application Data

(60) Provisional application No. 60/272,329, filed on Mar. 1, 2001.

(51) Int. Cl.[7] ..... B41M 5/40

(52) U.S. Cl. ..... 503/207; 427/150; 427/151; 427/152; 503/200; 503/226

(58) Field of Search ..... 503/200, 207, 503/226; 427/150, 151, 152

(56) References Cited

U.S. PATENT DOCUMENTS

| | | | | |
|---|---|---|---|---|
| 4,925,827 | A | 5/1990 | Goto et al. | 503/207 |
| 4,929,590 | A | 5/1990 | Maruta et al. | 503/207 |
| 5,342,649 | A | 8/1994 | Sarokin | 427/150 |

FOREIGN PATENT DOCUMENTS

| | | |
|---|---|---|
| EP | 0 774 363 A1 | 11/1996 |
| JP | 4220394 | 8/1992 |
| JP | 7137432 | 5/1995 |

*Primary Examiner*—B. Hamilton Hess
(74) *Attorney, Agent, or Firm*—Ronald D. Rakule

(57) ABSTRACT

A thermosensitive recording material comprising a support such as paper bearing thereon a first layer comprising multivoided particles and, disposed on the first layer, a thermosensitive recording layer is provided.

3 Claims, No Drawings

THERMOSENSITIVE RECORDING MATERIAL

CROSS REFERENCE TO RELATED PATENT APPLICATIONS

This is a non-provisional application of prior pending U.S. provisional application serial No. 60/272,329 filed Mar. 1, 2001.

This invention relates to a thermosensitive recording material. In particular, this invention relates to a thermosensitive recording material comprising a support bearing thereon a first layer comprising multivoided particles and, disposed on the first layer, a thermosensitive recording layer.

Various types of first layers in thermosensitive recording material are currently employed. The first layers typically contain filler particles, i.e., inorganic pigments, which may be used in above critical pigment volume concentration coatings. Minute void particles and layers that are expanded by expansion of a gas or a low boiling solvent in a foaming process have been disclosed (U.S. Pat. Nos. 5,102,693 and 5,137,864). It is believed that the most advantageous first layer contains the most air, which has a high insulating value, and is the smoothest and is sealed well enough to prevent the thermosensitive recording layer from wicking into the first layer.

U.S. Pat. No. 4,925,827 discloses a thermosensitive recording material bearing an undercoat layer comprising fine organic single voided particles having a specific ratio of wall thickness to particle diameter.

U.S. Pat. No. 4,929,590 discloses a thermosensitive recording material including an undercoat layer formed on a support which undercoat layer includes spherical hollow single-voided particles having a certain diameter and voidage and a binder resin.

It is desired to provide thermosensitive recording material with useful properties having a first layer which does not rely on the inclusion of single-voided particles, such single-voided spherical particles obtainable only by a carefully controlled multi-stage process in which the distinctness of the particle wall and core must be maintained. It has now surprisingly been found that a first layer including multivoided particles, multivoided particles with a less rigidly defined geometry, is useful in thermosensitive recording material.

In a first aspect of the present invention there is provided a thermosensitive recording material comprising a support bearing thereon a first layer comprising multivoided particles and, disposed on said first layer, a thermosensitive recording layer.

The thermosensitive recording material of this invention includes a support which may be, for example, paper, synthetic paper, plastic film, or metal film, typically in sheet or roll form as desired.

The first layer includes multivoided particles. Preferred are multivoided polymeric particles. The multivoided particles are typically from 0.1 micron to 2 microns in diameter, preferably 0.5 micron to 1.5 micron. Particle sizes herein are those determined using a Brookhaven Model BI-90 particle sizer manufactured by Brookhaven Instruments Corporation, Holtsville N.Y., reported as "effective diameter". Also contemplated are multimodal particle size emulsion polymers wherein two or more distinct particle sizes or very broad distributions are provided as is taught in U.S. Pat. Nos. 5,340,858; 5,350,787; 5,352,720; 4,539,361; and 4,456,726. Multiple voids are formed within a polymeric particle fully or partially enclosed by a shell polymer; by multiple voids herein is meant two or more voids, whether isolated or connected to other voids, whether substantially spherical in shape or not, including, for example, void channels, interpenetrating networks of void and polymer, and sponge-like structures.

In one embodiment the multivoided polymeric particles are made by a core-shell emulsion polymerization process in which the core polymer contains a copolymerized ester functional group-monomer, such as, for example, methyl acrylate, methyl methacrylate, and vinyl acetate, which may be hydrolyzed subsequent to or during shell polymer formation, and concurrently or subsequently treated with base to swell the particle and to form multiple voids within the particle when dried. Ethylenically unsaturated monomers used to form the shell composition include styrene, alpha-methyl styrene, esters of acrylic acid, esters of methacrylic acid, and acid functional monomers. Preferred is penetration of the shell polymer into the core polymer. Penetration of the shell polymer into the core polymer may be controlled by both thermodynamic and kinetic factors. Thermodynamic factors may determine the stability of the ultimate particle morphology according to the minimum surface free energy change principle. However, kinetic factors such as the viscosity of the core polymer at the polymerization temperature of the shell and the swelling time afforded the second stage polymer may modify the final degree of penetration. Thus, various process factors may control penetration of the shell into the core, and ultimately the morphology of the void structure in the expanded and dried particle. Such processes are known in the emulsion polymerization art such as, for example, in U.S. Pat. Nos. 5,036,109; 5,157,084; and 5,216,044. The glass transition temperature of the shell polymer is typically greater than 40° C. as calculated using the Fox equation; the particles may be crosslinked and may have functionalized surfaces.

There may be one or more first layers having the same or different compositions. There may be one or more additional layers or primer coats intermediate between the first layer and the support. The first layer includes the multivoided particles and may additionally include other components such as, for example, film-forming or non-film-forming polymeric binders, fillers, defoamers, crosslinking agents, surface active agents, and thermofusible materials. The amount of fillers should be such that they do not interfere with the effect of the multiple voided particles. The fillers are typically inorganic or polymeric pigments. Polymeric pigments are for example polystyrene, polyacrylic, polyethylene, etc. Inorganic pigments are for example calcium carbonate, kaolin, calcined kaolin, titanium dioxide, zinc oxide, aluminum hydroxide, zinc hydroxide, barium sulfate, silicon oxide, etc. Mixtures of the above may be used. The polymeric binders are preferably selected from conventionally known water soluble polymers and emulsion polymers. Examples of water soluble polymers are polyvinyl alcohol, acrylamide copolymer, methacrylamide copolymer starch and derivatives thereof, cellulose derivatives, sodium polyacrylate, polyvinyl pyrrolidone, acrylamide-acrylic acid ester copolymer, acrylamide-acrylic acid ester-methacrylic acid copolymer, alkali salts of styrene-maleic anhydride copolymer, alkali salts of isobutylene-maleic anhydride copolymer, sodium alginate, gelatin and casein. Examples of emulsion polymer compositions are styrene-butadiene copolymer, styrene-butadiene-acrylic acid copolymer, vinyl acetate homopolymer, vinyl acetate-acrylic acid copolymer, styrene-acrylic acid ester copolymer, acrylic acid ester copolymer, and polyurethane polymer. Polymeric binder systems containing both water soluble polymer(s) and aqueous emulsion polymer(s) can also be employed. Polymeric binder may also be provided during the production of the multi-voided particle as an outer sheath polymerized or associated by colloidal forces onto the outside of the multi-voided particle. The total weight of polymeric binder on a dry weight basis is preferably within the range 2–50% of the total weight of the filler and the multi-voided particles. Preferred is a first layer which is applied to the support as an aqueous composition.

The first layer is formed by drying, or by allowing to dry, at temperatures from 0° C. to 100° C. aqueous compositions which have been applied to the support. This insulating layer may optionally be applied in several steps. Preferred is a dried first layer containing from 10–80% by weight multi-voided particles. The first layer may be applied to the support by conventional methods, including, for example, by roll applicator, jet applicator, or spray methods. The applied layer may be metered and smoothed by any of a number of different application methods, including, for example, blade, air knife, smooth rod, and grooved rod. The final dried coat weight of the first layer is between 1 and 25 g/m2, preferably between 3 and 15 g/m2. It may optionally be calendered prior to the application of further coating layers. A second layer intermediate between the insulating layer and the thermosensitive recording layer may be applied generally for the purpose of absorbing liquid from the thermosensitive recording layer during imaging. However, this optional intermediate layer should be less than 10 g/m2 in coverage so as to not mask the advantages of the insulating layer underneath.

The thermosensitive recording layer is applied to the first layer(s). Typically dyes and color developers may be used in the thermosensitive recording layer. Leuco dyes well known to those in the art are typically employed. As color developers, various known oxidizing compounds which induce color formation in the leuco dyes upon the application of heat are usable. Examples of typical leuco dyes and color developers are found in U.S. Pat. No. 4,929,590. Binders, fillers, crosslinking agents, surface active agents, thermofusible materials and other additives may also be used in the thermosensitive recording layer. The fillers typically employed were hereinabove described as the fillers which may be utilized in the insulating layer. Polymeric binders typically used because of their thermal resistance to flow are polyvinyl alcohol, polyacrylamide, or polymethacrylamide.

The thermosensitive recording layer may also be coated with a protective layer for the purpose of shielding the thermosensitive recording layer from degradation due to contact with water, oil, alcohol, solvents, conventional printing inks, etc. The protective layer may also enhance print head thermal contact to the thermosensitive recording layer.

The following examples are presented to illustrate the invention.

EXAMPLE 1

Preparation of Multivoided Polymeric Particles by Emulsion Polymerization

A 5-liter round-bottomed flask is equipped with paddle stirrer, thermometer, nitrogen inlet and reflux condenser. To 2115 g of DI water heated to 84° C. in the flask under a nitrogen atmosphere there is added 4.2 g sodium persulfate dissolved in 25 g water followed by 26.9 g acrylic seed polymer dispersion (45% solids, average particle diameter 0.1 micron). A monomer emulsion consisting of 235 g DI water, 0.8 g sodium dodecylbenzene sulfonate, 280 g methyl acrylate, 126 g BA, 280 g MMA, 14 g MAA and 3.5 g divinyl benzene is added to the kettle over a 3-hour period at 85° C. After the completion of the monomer feed, the dispersion is held at 85° C. for 30 minutes, cooled to 25° C. and is filtered to remove coagulum. The filtered dispersion should have pH below 3, solids content of approximately 22.5%, and an average particle diameter of approximately 0.37 micron.

A 5-liter round-bottom flask equipped with a paddle stirrer, thermocouple, nitrogen inlet, and reflux condenser is charged with a mixture of 921 g hot DI water, 1.2 g sodium persulfate, and 296 g of the latent core latex prepared above. A monomer emulsion consisting of 300 g DI water, 5 g sodium dodecylbenzene sulfonate (23%), 500.0 g Sty, 26.6 g MAA, and 5.3 g acrylamide is prepared. Gradual addition of this monomer emulsion is begun as well as gradual addition of 2.9 g sodium persulfate in 18 g DI water while the mixture is maintained at 85° C. The addition of the monomer emulsion is then continued with the reaction temperature maintained at 85° C. for a total addition time of 4 hours. The reaction mixture is held at 85° C. for an additional 2 hours. The mixture is heated to 90° C. and 9 g sodium hydroxide in 36 g water is added. The mixture is held at 90° C. for 20 hours. The resulting dispersion contains particles having multiple voids in their interiors, as may be determined by scanning electron microscopy.

EXAMPLE 2

Preparation of a Thermosensitive Recording Material

An aqueous composition for formation of the first layer is prepared by mixing 100 parts by weight of the multivoided particles of Example 1 (29% solids), 12 parts by weight of a styrene/acrylic emulsion polymer at 50% solids (Rhoplex P-308, Rohm and Haas Company, Philadelphia, Pa.), 22 parts by weight of an aqueous solution of polyvinyl alcohol at 12% solids (Airvol 107, Air Products, Allentown, Pa.) and 1 part of water. The aqueous composition is coated with a #8 metering rod onto a paper support having a basis weight of 40 g/m2 to a dry coating weight of 5 g/m2 and may be dried for 1 minute at 80° C. Then an aqueous thermosensitive layer containing a leuco dye, a dye developer, polyvinyl alcohol and water is applied with a metering rod onto the first layer at a dry coating weight of 5 g/m2 and may be dried for 3 minutes at 50° C. The coated sheet is expected to exhibit a useful smoothness and high thermal sensitivity, yielding clear, high density images.

What is claimed is:

1. A thermosensitive recording material comprising a support bearing thereon a first layer comprising multivoided particles, said particles having been formed by (i) a core-shell emulsion polymerization process, said core comprising a copolymerized ester functional group-monomer, (ii) hydrolyzing said monomer subsequent to or during the formation of said shell, (iii) treating said core with base concurrently with or subsequently to said hydrolysis to swell said particle and (iv) forming multiple voids within said particle when dried, and, disposed on said first layer, a thermosensitive recording layer.

2. The thermosensitive recording material of claim 1 wherein said multivoided particles are polymeric multi-voided particles having a diameter from 0.1 micron to 2 microns.

3. A method for forming a thermosensitive recording material comprising providing a support bearing thereon a first layer comprising multivoided particles said particles being formed by (i) effecting a core-shell emulsion polymerization process, said core comprising a copolymerized ester functional group-monomer, (ii) hydrolyzing said monomer subsequent to or during the formation of said shell, (iii) treating said core with base concurrently or subsequently to said hydrolysis to swell said particle and (iv) forming multiple voids within said particle when dried; and, disposing on said first layer, a thermosensitive recording layer.

* * * * *